US012478139B2

(12) United States Patent
Siegismund et al.

(10) Patent No.: US 12,478,139 B2
(45) Date of Patent: Nov. 25, 2025

(54) ARTICLE OF FOOTWEAR HAVING A CLOSURE SYSTEM

(71) Applicant: PUMA SE, Herzogenaurach (DE)

(72) Inventors: Andreas Siegismund, Rueckersdorf (DE); Reinhold Sussmann, Scheinfeld (DE); Romain Girard, Lauf an der Pegnitz (DE)

(73) Assignee: PUMA SE, Herzogenaurach (DE)

( * ) Notice: Subject to any disclaimer, the term of this patent is extended or adjusted under 35 U.S.C. 154(b) by 108 days.

(21) Appl. No.: 18/085,065

(22) Filed: Dec. 20, 2022

(65) Prior Publication Data

US 2023/0189932 A1 Jun. 22, 2023

Related U.S. Application Data

(60) Provisional application No. 63/292,280, filed on Dec. 21, 2021.

(51) Int. Cl.

| | |
|---|---|
| ***A43C 1/00*** | (2006.01) |
| ***A43C 11/00*** | (2006.01) |
| ***A43C 11/14*** | (2006.01) |
| ***A43C 11/16*** | (2006.01) |

(52) U.S. Cl.

CPC ..... *A43C 11/1406* (2013.01); *A43C 1/00* (2013.01); *A43C 11/008* (2013.01); *A43C 11/165* (2013.01)

(58) Field of Classification Search

CPC ..... A43C 1/00; A43C 1/003; A43C 1/006; A43C 7/00; A43C 11/008; A43C 11/165

See application file for complete search history.

(56) References Cited

U.S. PATENT DOCUMENTS

| | | | | |
|---|---|---|---|---|
| 4,669,201 | A * | 6/1987 | Pozzobon | A43C 11/1413 36/118.9 |
| 4,735,004 | A * | 4/1988 | Dodge | A43B 5/0458 24/68 B |
| 4,761,859 | A * | 8/1988 | Calabrigo | A43C 11/16 24/69 SK |
| 4,937,952 | A * | 7/1990 | Olivieri | A43C 11/16 36/118.9 |
| 2017/0000210 | A1* | 1/2017 | Bigolin | A43C 11/16 |
| 2017/0049190 | A1* | 2/2017 | Maussen | A43B 3/26 |
| 2017/0303643 | A1* | 10/2017 | Converse | A43C 11/00 |
| 2017/0318908 | A1* | 11/2017 | Wyatt | A43B 3/38 |

* cited by examiner

*Primary Examiner* — Sharon M Prange
(74) *Attorney, Agent, or Firm* — Quarles & Brady LLP

(57) ABSTRACT

A closure system for an article of footwear includes a track, a knob, and a cord that is configured to be operably engaged with an upper of the footwear. The cord is attached to the knob and the knob is configured to be moved within the track to tighten and loosen the footwear.

10 Claims, 7 Drawing Sheets

ARTICLE OF FOOTWEAR HAVING A CLOSURE SYSTEM

CROSS-REFERENCE TO RELATED APPLICATIONS

This application claims the benefit of and priority to U.S. Provisional Application No. 63/292,280, filed on Dec. 21, 2021, which is incorporated by reference herein in its entirety.

REFERENCE REGARDING FEDERALLY SPONSORED RESEARCH OR DEVELOPMENT

Not applicable

SEQUENCE LISTING

Not applicable

BACKGROUND

1. Field of the Invention

The present disclosure relates generally to an article of footwear including a fastening system or closure system.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and a top portion. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulatable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper of many shoes may comprise a wide variety of materials, which may be utilized to form the upper and selected based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, in many cases, articles of footwear having uppers with an increased comfort and better fit are desired, along with improved closure mechanisms.

SUMMARY

An article of footwear, as described herein, may have various configurations. The article of footwear may have an upper and a sole structure connected to the upper.

In some aspects, a closure system for an article of footwear includes a track, a knob, and a cord that is configured to be operably engaged with an upper of the footwear. The cord is attached to the knob and the knob is configured to be moved within the track to tighten and loosen the footwear.

In some embodiments, the cord is operably engaged with a plurality of guides defining a winding region of the footwear. In other embodiments, the track has a first end that is located closer to the winding region than a second end. In different embodiments, the footwear is tightened when the knob is positioned at the second end of the track. In still other embodiments, the knob is configured to be translated and rotated within a channel defined by the track. In yet other embodiments, the track extends along the upper within the heel region. In some embodiments, the track extends across the upper and the sole.

In some aspects, a closure system for an article of footwear includes a track having a first end opposite a second end, where an engagement wall extends from the first end to the second end. The closure system also includes a knob that is configured to be received within the track. Further, the closure system includes and a cord that is configured to be operably received by the knob, the cord being inserted through openings formed in the track, and where the knob is configured to be moved from the first end to the second end of the track to tighten the footwear.

In some embodiments, the engagement wall defines a slot, a mounting hole, and a throat. In other embodiments, the mounting hole is located adjacent the second end of the track. In yet other embodiments, the slot extends linearly between the first end and the second end. In different embodiments, the engagement wall is positioned between a top end and a bottom end of a sidewall of the track. In some embodiments, the engagement wall defines a slot having a pit located adjacent the second end and the pit is separated from the slot by a bumper. In still other embodiments, the engagement wall defines a plurality of pits at the second end.

In some aspects, a closure system for an article of footwear includes a track having a first end and a second end, where an engagement wall extends from the first end to the second end. The closure system also includes a knob that is configured to be received within the track. Further, the closure system includes a cord that is configured to be operably received by the knob, the cord being inserted through openings formed in the track, and where the knob is configured to be rotated within the track to tighten the footwear.

In some embodiments, the knob includes a head and an axle. In other embodiments, the axle of the knob includes a first portion defining a first diameter and a second portion defining a second diameter. In still other embodiments, the axle of the knob includes an annular gasket disposed thereon. In yet other embodiments, the knob includes a head having an upper disc and a lower disc that are configured to rotate relative to one another. In different embodiments, the knob is configured to be translated within track to tighten and loosen the footwear.

Other aspects of the article of footwear, including features and advantages thereof, will become apparent to one of ordinary skill in the art upon examination of the figures and detailed description herein. Therefore, all such aspects of the article of footwear are intended to be included in the detailed description and this summary.

DETAILED DESCRIPTION OF THE DRAWINGS

Figure 1:
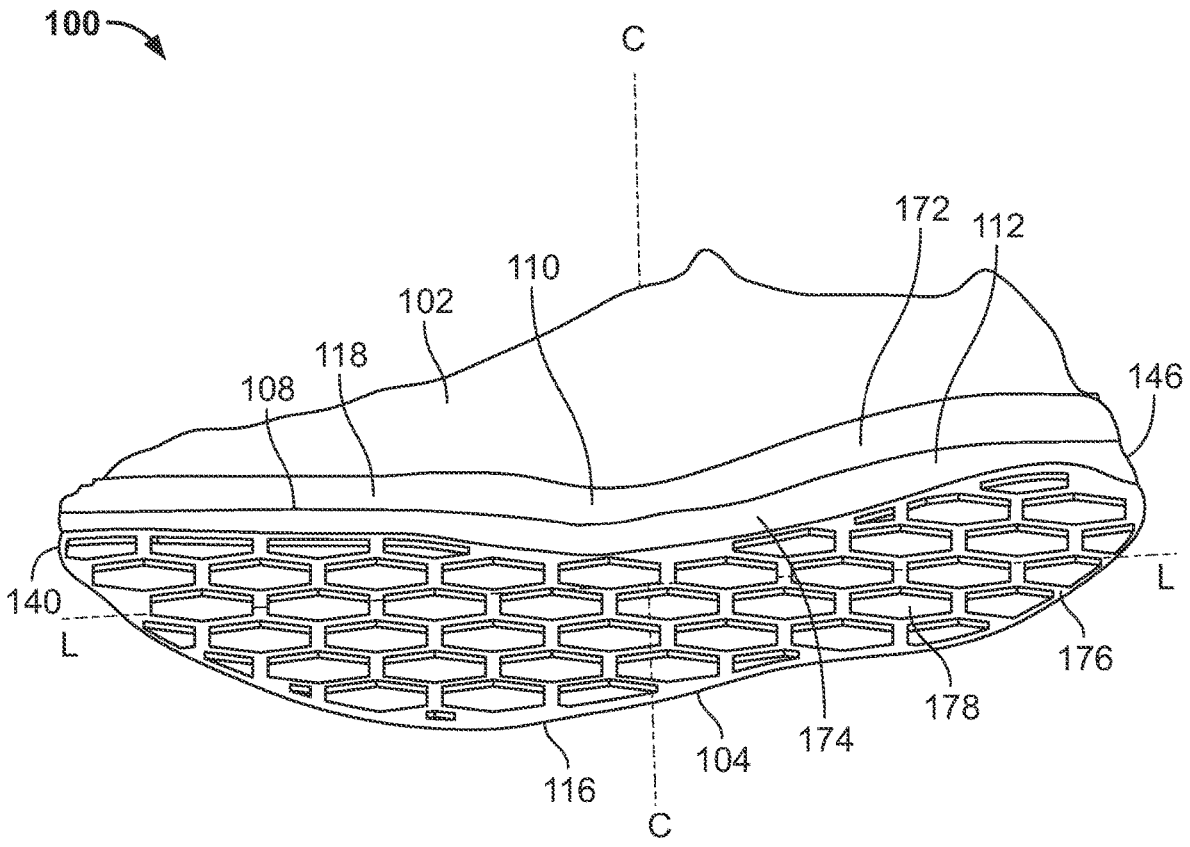
FIG. 1 is a perspective view of a bottom and medial side of an article of footwear configured as a right shoe that includes an upper and a sole structure, according to an embodiment of the disclosure.

The following discussion and accompanying figures disclose various embodiments or configurations of a shoe and a sole structure. Although embodiments of a shoe or sole structure are disclosed with reference to a sports shoe, such as a running shoe, tennis shoe, basketball shoe, etc., concepts associated with embodiments of the shoe or the sole structure may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe or the sole structure may also be applied to articles of footwear that are considered non-athletic, including dress shoes, sandals, loafers, slippers, and heels. In addition to footwear, particular concepts described herein may also be applied and incorporated in other types of apparel or other athletic equipment, including helmets, padding or protective pads, shin guards, and gloves. Even further, particular concepts described herein may be incorporated in cushions, backpack straps, golf clubs, or other consumer or industrial products. Accordingly, concepts described herein may be utilized in a variety of products.

The term "about," as used herein, refers to variation in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values±5% of the numeric value that the term precedes.

The present disclosure is directed to an article of footwear and/or specific components of the article of footwear, such as an upper and/or a sole or sole structure. The upper may comprise a knitted component, a woven textile, and/or a non-woven textile. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, and/or other suitable knitting operations. The knit textile may have a plain knit structure, a mesh knit structure, and/or a rib knit structure, for example. Woven textiles include, but are not limited to, textiles formed by way of any of the numerous weave forms, such as plain weave, twill weave, satin weave, dobbin weave, jacquard weave, double weaves, and/or double cloth weaves, for example. Non-woven textiles include textiles made by air-laid and/or spun-laid methods, for example. The upper may comprise a variety of materials, such as a first yarn, a second yarn, and/or a third yarn, which may have varying properties or varying visual characteristics.

Figure 2:
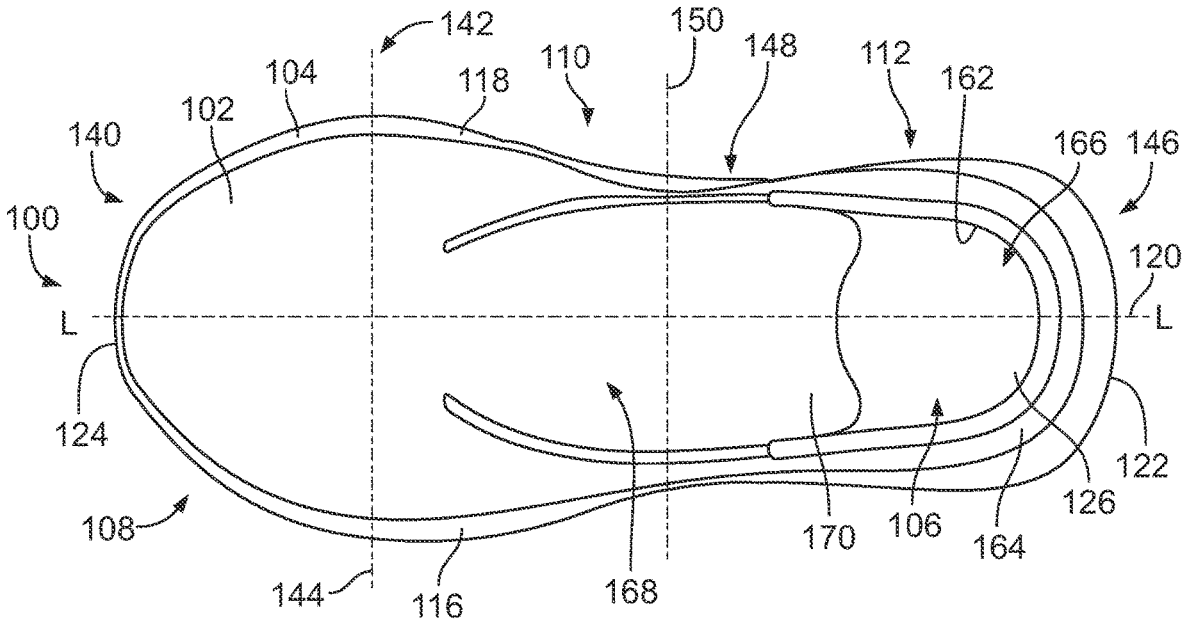
FIG. 2 is a top view of the article of footwear of FIG. 1.
Figure 3:
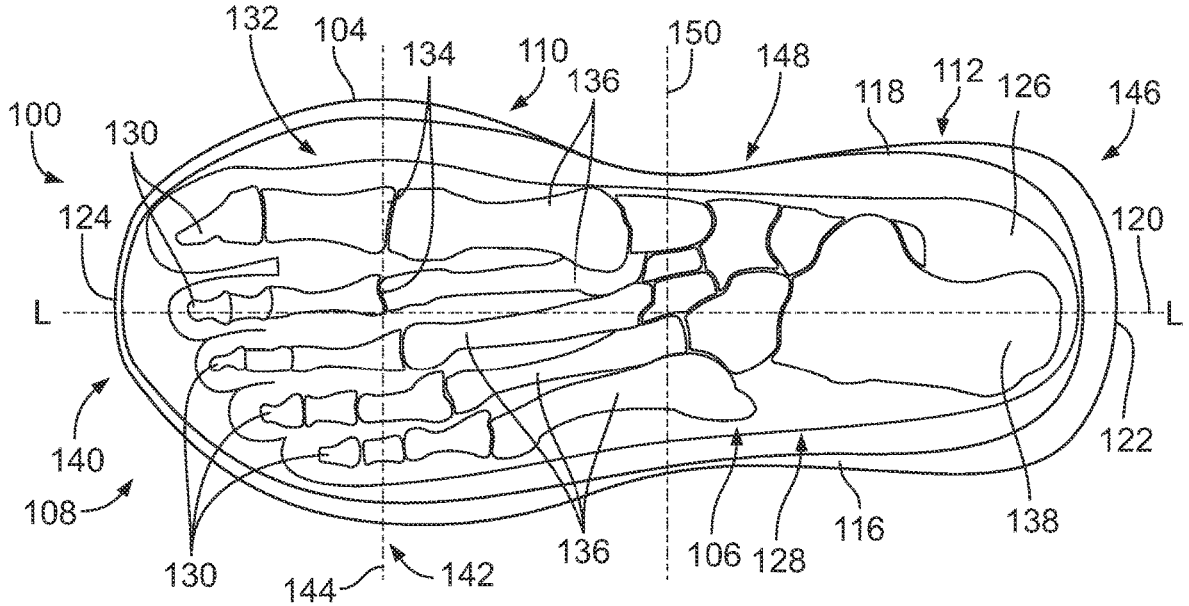
FIG. 3 is a top plan view of the article of footwear of FIG. 1, with an upper removed and a user's skeletal foot structure overlaid thereon.

FIGS. 1-3 depict an exemplary embodiment of an article of footwear 100 including an upper 102 and a sole structure 104. The upper 102 is attached to the sole structure 104 and together define an interior cavity 106 (see FIGS. 2 and 3)

into which a foot may be inserted. For reference, the article of footwear 100 defines a forefoot region 108, a midfoot region 110, and a heel region 112 (see FIGS. 2 and 3). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of the foot. The heel region 112 is proximate and adjoining the midfoot region 110 and generally corresponds with portions of the article of footwear 100 that encase rear portions of the foot, including the heel or calcaneus bone, the ankle, and/or the Achilles tendon.

Many conventional footwear uppers are formed from multiple elements, e.g., textiles, polymer foam, polymer sheets, leather, and synthetic leather, which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, one area of the upper 102 may be formed from a first type of yarn that imparts a first set of properties, and another area of the upper 102 may be formed from a second type of yarn that imparts a second set of properties. Using this configuration, properties of the upper 102 may vary throughout the upper 102 by selecting specific yarns for different areas of the upper 102.

With reference to the material(s) that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction. In further embodiments, the upper 102 may also include additional structural elements. For example, in some embodiments, a heel plate or cover (not shown) may be provided on the heel region 112 to provide added support to a heel of a user. In some instances, other elements, e.g., plastic material, logos, trademarks, etc., may also be applied and fixed to an exterior surface using glue or a thermoforming process. In some embodiments, the properties associated with the upper 102, e.g., a stitch type, a yarn type, or characteristics associated with different stitch types or yarn types, such as elasticity, aesthetic appearance, thickness, air permeability, or scuff-resistance, may be varied.

Referring again to FIG. 1, the sole structure 104 is connected or secured to the upper 102 and extends between a foot of a user and the ground when the article of footwear 100 is worn by the user. The sole structure 104 may include one or more components, which may include an outsole, a midsole, a heel, a vamp, and/or an insole. For example, in some embodiments, a sole structure may include an outsole that provides structural integrity to the sole structure, along with providing traction for a user, a midsole that provides a cushioning system, and an insole that provides support for an arch of a user. In addition, the insole may be a strobel board, a forefoot board, a lasting board, etc., or a combination thereof, and the insole may be provided between the upper 102 and the sole structure 104, or the insole may be provided as part of the upper 102.

Furthermore, the insole can be positioned within the interior cavity 106 of the upper 102, which can be in direct contact with a user's foot while an article of footwear 100 is being worn. Moreover, the upper 102 may also include a liner (not shown) that can increase comfort, for example, by reducing friction between the foot of the user and the upper 102, the sole 104, the insole, or the like, and/or by providing moisture wicking properties. The liner may line the entirety of the interior cavity 106 or only a portion thereof. In some embodiments, a binding (not shown) may surround an opening of the interior cavity 106 to secure the liner to the upper 102 and/or to provide an aesthetic element on the article of footwear 100.

Referring to FIGS. 2 and 3, the article of footwear 100 also defines a lateral side 116 and a medial side 118. When a user is wearing the shoes, the lateral side 116 corresponds with an outside-facing portion of the article of footwear 100 while the medial side 118 corresponds with an inside-facing portion of the article of footwear 100. As such, the article of footwear 100 has opposing lateral sides 116 and medial sides 118. The medial side 118 and the lateral side 116 adjoin one another along a longitudinal central plane or axis 120 of the article of footwear 100, which is coplanar with the longitudinal axis L of FIG. 1. As will be further discussed herein, the longitudinal central plane or axis 120 may demarcate a central, intermediate axis between the medial side 118 and the lateral side 116 of the article of footwear 100. Put differently, the longitudinal plane or axis 120 may extend between a rear, proximal end 122 of the article of footwear 100 and a front, distal end 124 of the article of footwear 100 and may continuously define a middle of an insole 126, the sole structure 104, and/or the upper 102 of the article of footwear 100, i.e., the longitudinal plane or axis 120 is a straight axis extending through the rear, proximal end 122 of the heel region 112 to the front, distal end 124 of the forefoot region 108.

Unless otherwise specified, and referring to FIGS. 2 and 3, the article of footwear 100 may be defined by the forefoot region 108, the midfoot region 110, and the heel region 112. The forefoot region 108 may generally correspond with portions of the article of footwear 100 that encase portions of a foot 128 that include the toes or phalanges 130, the ball of the foot 132, and one or more of the joints 134 that connect the metatarsals 136 of the foot 128 with the toes or phalanges 130. The midfoot region 110 is proximate and adjoins the forefoot region 108. The midfoot region 110 generally corresponds with portions of the article of footwear 100 that encase an arch of a foot 128, along with a bridge of the foot 128. The heel region 112 is proximate to the midfoot region 110 and adjoins the midfoot region 110. The heel region 112 generally corresponds with portions of the article of footwear 100 that encase rear portions of the foot 128, including the heel or calcaneus bone 138, the ankle (not shown), and/or the Achilles tendon (not shown).

Still referring to FIGS. 2 and 3, the forefoot region 108, the midfoot region 110, the heel region 112, the medial side 118, and the lateral side 116 are intended to define boundaries or areas of the article of footwear 100. To that end, the forefoot region 108, the midfoot region 110, the heel region 112, the medial side 118, and the lateral side 116 generally characterize sections of the article of footwear 100. Certain aspects of the disclosure may refer to portions or elements that are coextensive with one or more of the forefoot region 108, the midfoot region 110, the heel region 112, the medial side 118, and/or the lateral side 116. Further, both the upper 102 and the sole structure 104 may be characterized as having portions within the forefoot region 108, the midfoot region 110, the heel region 112, and/or along the medial side 118 and/or the lateral side 116. Therefore, the upper 102 and the sole structure 104, and/or individual portions of the upper 102 and the sole structure 104, may include portions thereof that are disposed within the forefoot region 108, the midfoot region 110, the heel region 112, and/or along the medial side 118 and/or the lateral side 116.

Still referring to FIGS. 2 and 3, the forefoot region 108, the midfoot region 110, the heel region 112, the medial side 118, and the lateral side 116 are shown in detail. The forefoot region 108 extends from a toe end 140 to a widest portion 142 of the article of footwear 100. The widest portion 142 is defined or measured along a first line 144 that is perpendicular with respect to the longitudinal axis 120 that extends from a distal portion of the toe end 140 to a distal portion of a heel end 146, which is opposite the toe end 140. The midfoot region 110 extends from the widest portion 142 to a thinnest portion 148 of the article of footwear 100. The thinnest portion 148 of the article of footwear 100 is defined as the thinnest portion of the article of footwear 100 measured across a second line 150 that is perpendicular with respect to the longitudinal axis 120. The heel region 112 extends from the thinnest portion 148 to the heel end 146 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 118, and/or the lateral side 116 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 118, and/or the lateral side 116 discussed herein.

Still referring to FIGS. 2 and 3, the medial side 118 begins at the distal, toe end 140 and bows outward along an inner side of the article of footwear 100 along the forefoot region 108 toward the midfoot region 110. The medial side 118 reaches the first line 144, at which point the medial side 118 bows inward, toward the central, longitudinal axis 120. The medial side 118 extends from the first line 144, i.e., the widest portion 142, toward the second line 150, i.e., the thinnest portion 148, at which point the medial side 118 enters into the midfoot region 110, i.e., upon crossing the first line 144. Once reaching the second line 150, the medial side 118 bows outward, away from the longitudinal, central axis 120, at which point the medial side 118 extends into the heel region 112, i.e., upon crossing the second line 150. The medial side 118 then bows outward and then inward toward the heel end 146, and terminates at a point where the medial side 118 meets the longitudinal, central axis 120.

The lateral side 116 also begins at the distal, toe end 140 and bows outward along an outer side of the article of footwear 100 along the forefoot region 108 toward the midfoot region 110. The lateral side 116 reaches the first line 144, at which point the lateral side 116 bows inward, toward the longitudinal, central axis 120. The lateral side 116 extends from the first line 144, i.e., the widest portion 142, toward the second line 150, i.e., the thinnest portion 148, at which point the lateral side 116 enters into the midfoot region 110, i.e., upon crossing the first line 144. Once reaching the second line 150, the lateral side 116 bows outward, away from the longitudinal, central axis 120, at which point the lateral side 116 extends into the heel region 112, i.e., upon crossing the second line 150. The lateral side 116 then bows outward and then inward toward the heel end 146, and terminates at a point where the lateral side 116 meets the longitudinal, central axis 120.

Still referring to FIGS. 2 and 3, the upper 102 extends along the lateral side 116 and the medial side 118, and across the forefoot region 108, the midfoot region 110, and the heel region 112 to house and enclose a foot of a user. When fully assembled, the upper 102 also includes an interior surface 162 and an exterior surface 164. The interior surface 162 faces inward and generally defines the interior cavity 106, and the exterior surface 164 of the upper 102 faces outward and generally defines an outer perimeter or boundary of the upper 102. The upper 102 also includes an opening 166 that is at least partially located in the heel region 112 of the article of footwear 100, which provides access to the interior cavity 106 and through which a foot may be inserted and removed. In some embodiments, the upper 102 may also include an instep region 168 that extends from the opening 166 in the heel region 112 over an area corresponding to an instep of a foot to an area proximate the forefoot region 108. The instep region 168 may comprise an area similar to where a tongue 170 of the present embodiment is disposed. In some embodiments, the upper 102 does not include the tongue 170, i.e., the upper 102 is tongueless.

In the illustrated embodiment, the sole structure 104 includes a midsole 172 and an outsole 174. The outsole 174 may define a bottom end or bottom surface 176 of the sole structure 104 across the heel region 112, the midfoot region 110, and the forefoot region 108. Further, the outsole 174 may be a ground-engaging portion or include a ground-engaging surface of the sole structure 104 and may be opposite of the insole thereof. As illustrated in FIG. 1, the bottom surface 176 of the outsole 174 may include a tread pattern 178 that can include a variety of shapes and configurations. The outsole 174 may be formed from one or more materials to impart durability, wear-resistance, abrasion resistance, or traction to the sole structure 104. In some embodiments, the outsole 174 may be formed from any kind of elastomer material, e.g., rubber, including thermoset elastomers or thermoplastic elastomers, or a thermoplastic material, e.g., thermoplastic polyurethane (TPU). In some embodiments, the outsole 174 may define a shore A hardness up to 95. In addition, the outsole 174 may be manufactured by a process involving injection molding, vulcanization, printing layer by layer, i.e., additive manufacturing systems or methods, and the like.

Still referring to FIG. 1, the midsole 172 may be individually constructed from a thermoplastic material, such as polyurethane (PU), for example, and/or an ethylene-vinyl acetate (EVA), copolymers thereof, or a similar type of material. In other embodiments, the midsole 172 may be an EVA-Solid-Sponge ("ESS") material, an EVA foam (e.g., PUMA® ProFoam Lite™, IGNITE Foam), polyurethane, polyether, an olefin block copolymer, organosheets, a thermoplastic material (e.g., a thermoplastic polyurethane, a thermoplastic elastomer, a thermoplastic polyolefin, etc.), or a supercritical foam. The midsole 172 may be a single polymeric material or may be a blend of materials, such as an EVA copolymer, a thermoplastic polyurethane, a polyether block amide (PEBA) copolymer, and/or an olefin block copolymer. One example of a PEBA material is PEBAX®. In some embodiments, the midsole 172 is manufactured by a process involving injection molding, vulcanization, printing layer by layer, i.e., additive manufacturing systems or methods, and the like.

In embodiments where the midsole 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam. In further embodiments, the midsole 172 may be formed using alternative methods known in the art, including the use of an expansion press, an injection machine, a pellet expansion process, a cold foaming process, a compression molding technique, die cutting, or any combination thereof. For example, the midsole 172 may be formed using a process that involves an initial foaming step in which supercritical gas is used to foam a material and then compression molded or die cut to a particular shape.

Figure 4:
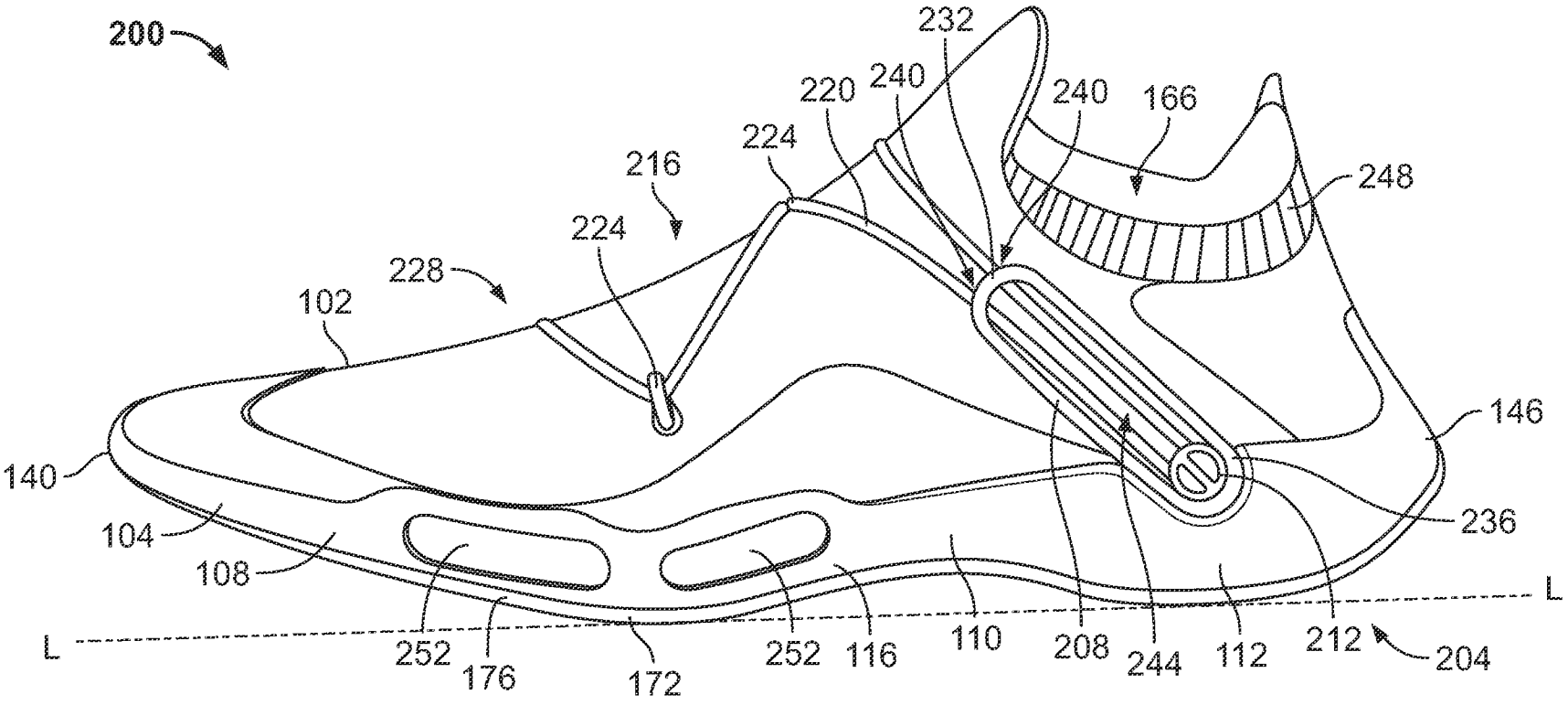
FIG. 4 is a schematic representation of a side elevational view of a lateral side of an article of footwear having a closure system according to an embodiment of the present disclosure.

FIG. 4 depicts a schematic representation of an article of footwear 200 that is similar to the article of footwear 100 of FIGS. 1-3. Accordingly, like reference numerals will be used to indicate like elements. As illustrated in FIG. 4, the article of footwear 200 has a fastening system or closure system 204 for tightening or loosening the upper 102 and/or the sole 104 around a user's foot. In the illustrated embodiment, the closure system 204 includes a track 208 and a knob 212. The track 208 is positioned on the lateral side 118 of the footwear 200 and extends from the upper 102 to the sole 104. Further, the footwear 200 includes a winding region 216 on the upper 102. The closure system 204 further includes a cord 220 that is operably engaged, e.g., threaded through, a plurality of guides 224 or eyes arranged on the winding region 216 of the upper 102. In some embodiments, the guides 224 are arranged in a winding pattern 228 so that the cord 220 can be threaded through for tightening or loosening the upper 102 and/or the sole 104 around a user's foot. To that end, the guides 224 are spaced apart from one another and located on the lateral side 116 and the medial side 118. The cord 220 extends across the upper 102 from the lateral side 116 to the medial side 118 in a serpentine fashion, i.e., the winding pattern 228, so that when the cord 220 is tightened, the cord 220 pulls the guides 224 closer to one another, thereby tightening the upper 102 and/or the sole 104 around a user's foot. Similarly, when the cord 220 is loosened, the guides 224 can expand relative to one another to loosen the upper 102 and/or the sole 104 around a user' foot. It is contemplated that the cord 220 and the guides 224 can be concealed or hidden from view by a cover (not shown), or by embedding the cord 220 and the guides 224 within layers of the upper 102. Further, the guides 224 can be coupled to or formed in the sole 104 on both the lateral and medial sides 116, 118, such that when the cord 220 is tightened the guides 224 wrap the sole 104 around the user's foot by bringing the lateral side 116 and medial side 118 toward one another, e.g., upward and inward relative to the foot. It is contemplated that the guides 224 can be located in various regions of the footwear 200, such as in the heel region 112 and the forefoot region 108, among other configurations.

Figure 5:
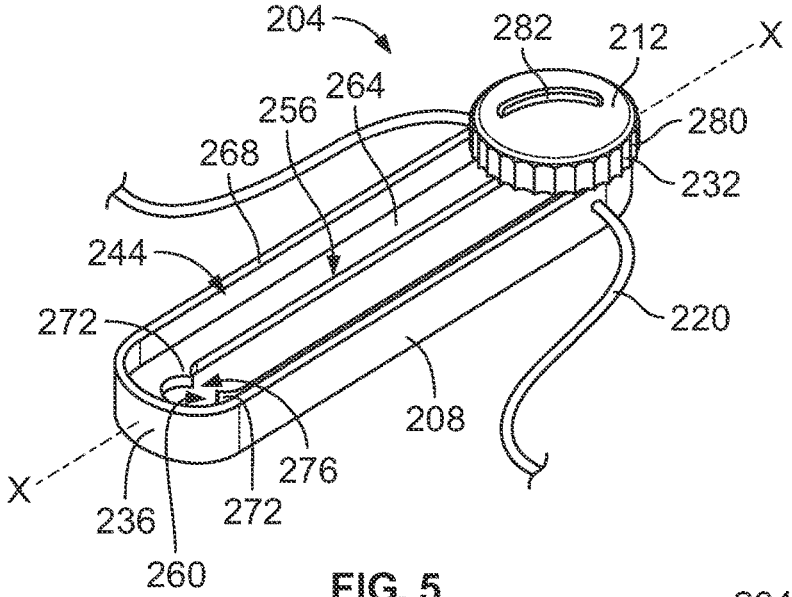
FIG. 5 is a schematic representation of a track and a knob of the closure system of FIG. 4, the knob being positioned in a loosened configuration.
Figure 6:
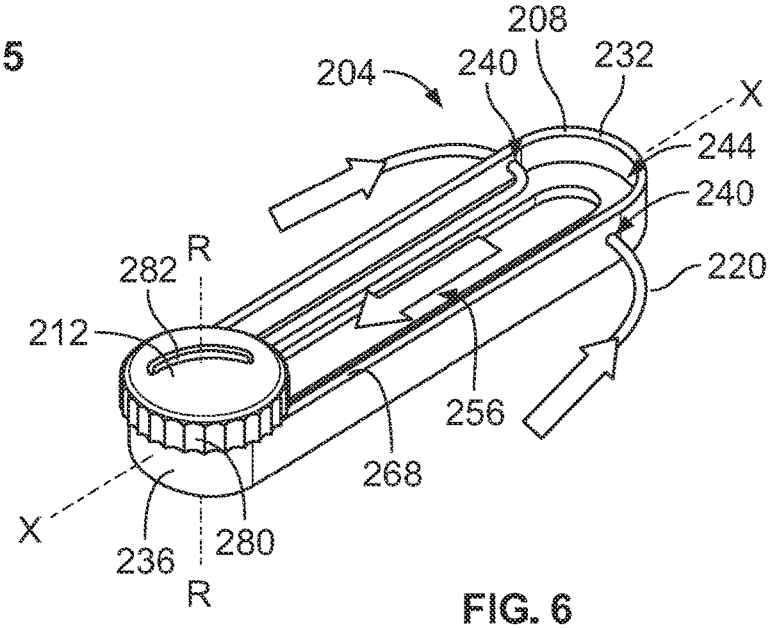
FIG. 6 is a schematic representation of the track and knob of the closure system of FIG. 4, the knob being positioned in a tightened configuration.

Still referring to FIG. 4, the track 208 has a first end 232 that is located on the upper 102 and generally within the midfoot region 110 of the footwear 200, while a second end 236 is located on the sole 104 and generally within the heel region 112 of the footwear 200. As such, the first end 232 of the track 208 is located closer to the winding region 216 than the second end 236 of the track 208. Turning to FIGS. 5 and 6, a pair of openings 240 are formed in the track 208 through which portions of the cord 220 are inserted, and a channel 244 is formed in the track 208 where portions of the cord 220 are operably received, such as, e.g., being fixedly or movably attached. Further, the channel 244 receives the knob 212 for sliding and/or rotational movement therein. In the illustrated embodiment, the track 208 is attached to both the upper 102 and the sole 104, and may be attached by being adhered, glued, fastened, or otherwise coupled to both the upper 102 and the sole 104.

As illustrated in FIG. 4, the channel 244 extends from the first end 232 to the second end 236 of the track 208, such that the knob 212 can be selectively moved, e.g., by sliding, from the first end 232 to the second end 236 within the channel 244. Accordingly, when a user desires to tighten the footwear 200, the knob 212 can be translated from the first end 232 to the second end 236 by sliding through the channel 244 of the track 208, i.e., moving the knob 212 away from the winding region 216. In this way, more of the cord 220 is pulled through the openings 240 and into the channel 244, which results in the cord 220 exerting a tightening force within the winding region 216 to pull the guides 224 closer together and, thus, tighten the upper 102 and/or sole 104 around the user's foot. Further, the cord 220 is coupled to the knob 212 to provide additional tightening and loosening functionalities, such as by rotation of the knob 212 to cause portions of the cord 220 to become wrapped around a portion of the knob 212. When a user desires to loosen the footwear 200, the knob 212 can be translated from the second end 236 to the first end 232 by sliding through the channel 244 of the track 208, i.e., moving the knob 212 toward the winding region 216. In this way, less of the cord 220 is pulled through the openings 240 and into the channel 244, which results in the cord 220 relaxing within the winding region 216 to allow the guides 224 to expand and, thus, loosen the upper 102 and/or the sole 104 around a user's foot.

The article of footwear 200 of FIG. 4 also depicts a collar 248 extending from the upper 102, which may be formed of a fabric/elastic material for expanding around a user's ankle.

In addition the medial side 118 of the sole 104 includes cushioning elements 252 within the forefoot region 108. The cushioning elements 252 may comprise recesses formed in the sole 104 that allow for greater bending and torsional flexibility in the forefoot region 108. For example, recesses extending into the sole 104 from the medial side 118 toward the lateral side 116 can provide reaction forces similar to a trampoline, causing a user to experience dampening upon impact and a spring-like reaction force after impact. It is further contemplated that the cushioning elements 252 may be configured as bladders that are pressurized to increase dampening and/or stiffness properties of the sole 104. In some embodiments, the cushioning elements 252 are filled with a fluid, a gas, or solid particles, or some combination thereof, to further impact dampening and/or stiffness properties of the sole 104.

Referring now to FIG. 5, the track 208, which is a schematic representation of the track 208 of FIG. 4, is shown in greater detail. The track 208 includes a slot 256 and a mounting hole 260 formed in an engagement wall 264. In the illustrated embodiment, the slot 256 extends linearly along the track 208, parallel with a translation axis X defined by the track 208. A sidewall 268 of the track 208 surrounds the channel 244 and includes the first end 232, being located opposite the mounting hole 260, and the second end 236, being located adjacent the mounting hole 260. The slot 256 extends at least partially from the first end 232 to the second end 236. In the illustrated embodiment, the track 208 has a retention feature in the form of a pair of projections 272 extending inwardly toward one another to define a narrowed throat 276 between the mounting hole 260 and the slot 256, such that the throat 276 is narrower than the mounting hole 260 and the slot 256. As illustrated in FIG. 5, the throat 276 and the projections 272 are located closer to the second end 236 than to the first end 232.

In the illustrated embodiment, the knob 212 is provided with ridges 280 about its circumference and a curved surface member 282 for improving a user's grip of the knob 212. In the illustrated embodiment of FIG. 5, the knob 212 is positioned at the first end 232. In FIGS. 4 and 6, the knob 212 is positioned at the second end 236 where it is retained in the mounting hole 260. To accomplish this, the knob 212 has been translated, as indicated by the imaginary central arrow provided for clarity, along the translation axis X of the track within the slot 256 and through the throat 276 formed by the projections 272 until the knob 212 is secured within the mounting hole 260. To that end, portions of the cord 220 are pulled into the channel 244, as indicated by the outer arrows, through the openings 240 formed in the sidewall 268 of the track 208. The openings 240 are preferably located equidistant from the second end 236 and closer to the first end 232 than to the second end 236.

Figure 7:
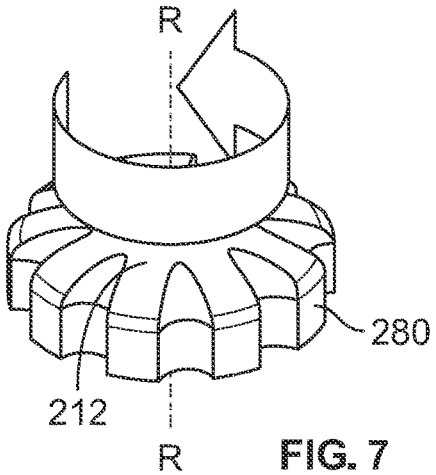
FIG. 7 is a schematic representation of the knob of FIG. 6.

In another aspect, the knob 212 is configured to be rotated within the track 208 for further adjustment of the cord 220 to tighten or loosen the footwear 200 around the user's foot. As illustrated in FIGS. 6 and 7, the knob 212 defines a rotation axis R about which the knob 212 is rotated in either a clockwise or counterclockwise direction. Upon rotation in either direction, the cord 220 becomes wrapped around a portion of the knob 212 within the channel 244, thereby pulling more of the cord 220 into the channel 244 of the track 208 through the openings 240 and, thus, exerting a greater tightening force on the guides 224 to tighten the footwear 200 around a user's foot. In this way, the knob 212 and the track 208 are configured to provide multiple means of tightening or loosening the footwear 200 around a user's foot. In particular, the knob 212 and the track 208 allow for coarse adjustments, i.e., large increments, to tightening or loosening the footwear 200, such as by sliding, and fine adjustments, i.e., smaller increments, to tightening or loosening the footwear 200, such as by rotation.

Figure 8:
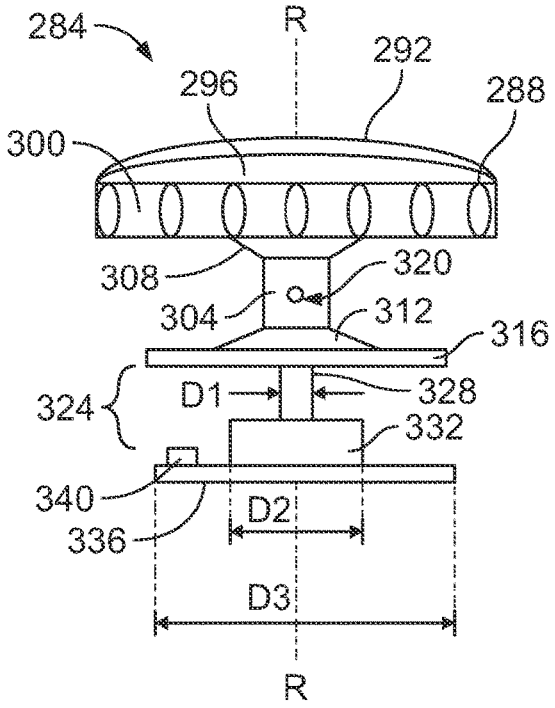
FIG. 8 is a schematic representation of a side elevational view of another embodiment of a knob for a closure system for an article of footwear.

FIG. 8 depicts a schematic representation of a knob 284 similar to the knob 212 of FIGS. 4-7. The knob 284 includes a head 288 with a fin 292 extending outwardly from a top surface 296 thereof. In the illustrated embodiment, the fin 292 and top surface 296 are curved, although other configurations are possible. Further, the head 288 further includes ridges 300 spaced radially around a circumference thereof for assisting a user with gripping the head 288 of the knob 284. The head 288 is connected to a spool 304 by an upper ramp 308. As illustrated in FIG. 8, the upper ramp 308 is depicted as a frustoconical surface extending from the head 288 to the spool 304, although the upper ramp 308 may be differently sized and shaped. Further, a lower ramp 312 connects the spool 304 to a flange 316, and the lower ramp 312 is also a frustoconical surface similar to the upper ramp 308 but is disposed in an inverted orientation relative thereto. The spool 304 also includes a passage 320 extending transversely relative to the rotational axis R, such that a portion of the cord 220 can be threaded or passed into and through the passage 320 to become attached to the knob 284. Because of the location of the passage 320 on the spool 304, portions of the cord 220 become wrapped around the spool 304 when the knob is rotated about the rotation axis R.

Figure 9:
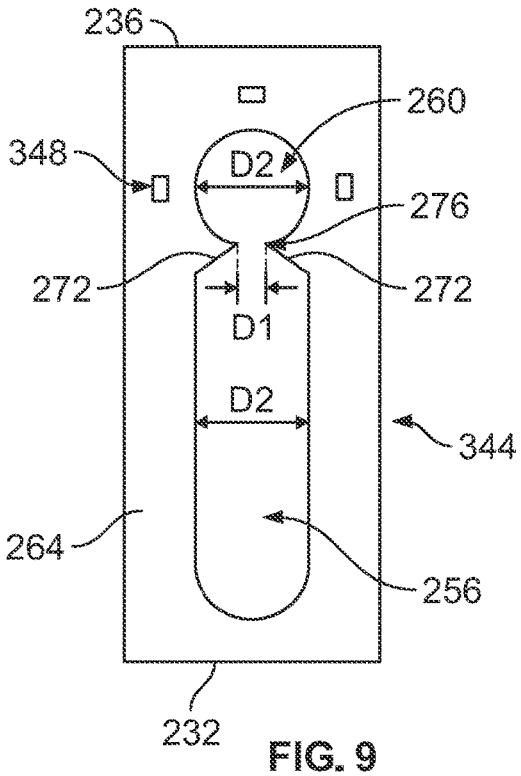
FIG. 9 is a schematic representation of a top plan view of another embodiment of a track for the closure system of the knob of FIG. 8.

Still referring to FIG. 8, the flange 316 is an annular, disc-shaped component that separates the spool 304, and any portions of the cord 220 wrapped thereon, from a tiered axle 324. The tiered axle 324 extends from the flange 316 opposite the spool 304 and concentrically with the head 288, the spool 304, and the flange 316 relative to the rotational axis R. The tiered axle 324 includes a first portion 328 extending between the flange 316 and a second portion 332 of the tiered axle 324, and the second portion 332 extends between the first portion 328 and a base 336 of the knob 212. The first portion 328 of the tiered axle 324 defines a first diameter D1, the second portion of the tiered axle 324 defines a second diameter D2, and the base 336 defines a third diameter D3. The first diameter D1 is less than both the second diameter D2 and the third diameter D3. As illustrated in FIG. 8, the second diameter D2 is smaller than the third diameter D3 and larger than the first diameter D1. As will be described below, the tiered axle 324 is configured to allow the knob 284 to slide within a track 344, as depicted in FIG. 9. Referring back to FIG. 8, the second portion 332 of the tiered axle 324 is provided as a generally cylindrical axle with a smooth outer surface, although other configurations are possible. Further, a tab 340 extends from the base 336 toward the flange 316, i.e., vertically upward from the base 336. Although one tab 340 is depicted in the illustrated embodiment, it is contemplated that a plurality of tabs 340 may be arranged on the base 336. It will be appreciated that the tiered axle 324 and the tab(s) 340 of the base 336 cooperate as a locking feature of the knob 284.

Referring to FIGS. 8 and 9, the knob 284 and the track 344 together comprise another embodiment of a closure system for the footwear 200. In the illustrated embodiment, the track 344, which is similar to the track 208 of FIGS. 4-7, includes the mounting hole 260, throat 276, and slot 256 configured to correspond with the knob 284 of FIG. 8. To that end, the mounting hole 260 and the slot 256 define a dimension corresponding to the second diameter D2, and the throat 276 defines a dimension corresponding to the first diameter D1. As such, when the knob 284 is engaged with the track 344 in a locked configuration, i.e., the knob 284 is received within the mounting hole 260 at the second end 236 of the track 344, the knob 284 is configured to be rotatably secured within the mounting hole 260 by fitting the second portion 332 of the tiered axle 324 into the mounting hole 260. This can be accomplished by a user lifting the knob 284 in a direction away from the track 344 until the base 336 is brought into contact with the track 344. Further, the knob 284 can be rotated about the rotation axis R so that the cord 220 is wrapped around the spool 304, and then locked into place by fitting the tab 340 into an aperture 348 formed through the engagement wall 264 of the track 344 near the mounting hole 260, thereby preventing unwinding of the cord 220 from the spool 304. Further, the tab 340 is configured to fit within the aperture 348 via an interference fit to couple the base 336 to the track 344. When a user desires to rotate the knob 284, a downward pressing force can be exerted on the head 288 of the knob 284 to dislodge the tab 340 from the aperture 348. Because the mounting hole 260 and the second portion 332 of the tiered axle 324 have the same diameter D2, rotation and vertical translation of the second portion 332 within the mounting hole 260 will be resisted by friction between the second portion 332 and the engagement wall 264 of the track 344. In other embodiments, the rotation and vertical translation of the second portion 332 within the mounting hole is not, or substantially not, effected by frictional resistance between the second portion 332 and the engagement wall 264; rather, tensional forces pulling on portions of the knob 284 from the cord 220 have been found to prevent substantial vertical and/or rotational displacement of the knob 284 without user intervention.

Still referring to FIGS. 8 and 9, the track 344 has a generally linearly extending slot 256 between the first end 232 and the second end 236, similar to the track 208. Accordingly, to move the knob 284 from the second end 236 to the first end 232, thereby loosening the footwear 200, a user can press down on the head 288 of the knob 284 to cause the second portion 332 to move out of engagement within the mounting hole 260, such that the first portion 328 of the tiered axle 324 becomes positioned within the mounting hole 260 and the flange 316 rests against the engagement wall 264 of the track 344. Because the first diameter D1 of the first portion 328 is smaller than the second diameter D2 of the second portion 332 and also of the mounting hole 260, the first portion 328 of the tiered axle 324 moves freely within the mounting hole 260. Further, due to tension applied to the knob 284 by the cord 220 in the tightened configuration, i.e., where the knob 284 is located at the second end 236 of the track 344, the first portion 328 may be pulled toward the throat 276 of the track 344. It is also contemplated that a user can press down on the head 288 of the knob 284 and also push the knob 284 toward the throat 276 of the track 344 manually, with or without assistance from the tension force applied by the cord 220. Then, because the first diameter D1 is equivalent to the dimension of the throat 276, the first portion 328 is configured to move through the throat 276 of the track 344 and into the slot 256. Once the first portion 328 is located within the slot 256, a user can move the knob 284 toward the first end 232 to fully relieve tension in the cord 220, eliminating the tightening forces on the guides 224 in the winding region 216, and allowing the footwear 200 to relax, i.e., loosen, for ingress or egress of a user's foot.

A user can selectively move, e.g., slide, the knob 284 back toward the second end 236 by sliding the first portion 328 through the slot 256 to the throat 276. The knob 284 is then pulled or pushed to move the first portion 328 of the tiered axle 324 through the throat 276 and into the mounting hole 260. Next, a user pulls upward on the head 288 of the knob 284 to lift the first portion 328 out of the mounting hole 260 and to bring the second portion 332 into position within the mounting hole 260 for engagement with the engagement wall 264 of the track 344. In doing so, the knob 284 is moved into a semi-locked configuration. In this semi-locked configuration, the footwear 200 is substantially tightened around a user's foot due to the tension or pulling force transmitting to the guides 224 in the winding region 216 by the cord 220 via translation of the knob 284 away from the winding region 216, i.e., toward the second end of the track 344. As such, in the semi-locked configuration, the knob 284 is secured within the mounting hole 260 from translation along the track 344, at least in part by the engagement between the projections 272 of the throat 276 and the second diameter D2 of the second portion 332 of the tiered axle 324. To further move the knob 284 into a locked configuration, a user then aligns the tab 340 of the base 336 on the knob 284 with one of the apertures 348 on engagement wall 264 of the track 344, such as by rotating the knob 284 about the rotation axis R. This also involves winding portions of the cord 220 around the spool 304, directed by the upper ramp 308 and lower ramp 312, which results in fine adjustment to the tensioning force applied to the footwear 200. In this manner, the knob 284 and the track 344 are configured to be manipulated by rotation and translation to selectively tighten and loosen the footwear 200.

Figure 10:
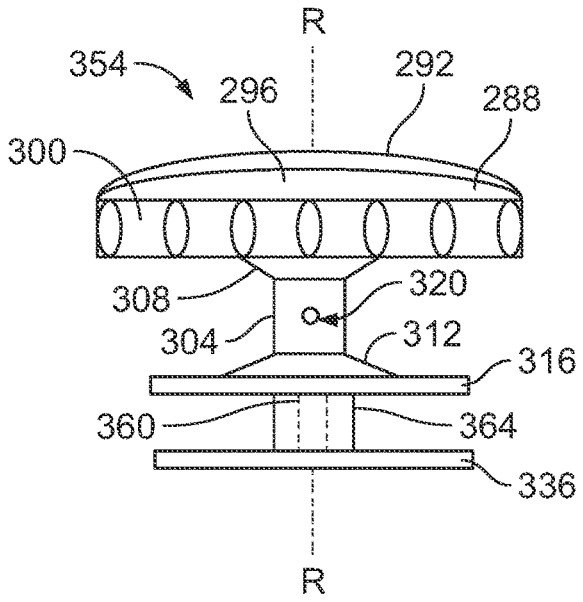
FIG. 10 is a schematic representation of a side elevational view of still another embodiment of a knob for a closure system for an article of footwear.
Figure 11:
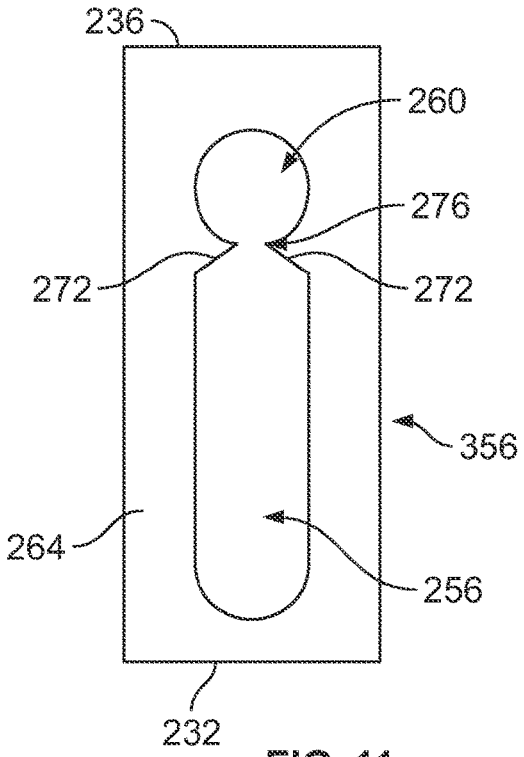
FIG. 11 is a schematic representation of a top plan view of another embodiment of a track for the closure system of the knob of FIG. 10.

FIGS. 10 and 11 depict an alternative embodiment of a knob 354 and a track 356, which together comprise still another embodiment of a closure system that is similar to the system described in connection with FIGS. 8 and 9. As such, like reference numerals will be used to indicate like structure. As illustrated in FIG. 10, the knob 354 has substantially the same structure as the knob of FIG. 8, but the spool 304 is connected between the head 288 and an axle 360 having an annular gasket 364 fit around and coupled to the axle 360 between the base 336 and the flange 316. In particular, the annular gasket 364 is configured to be compressed by the engagement wall 264 of the track 356. As such, the annular gasket 364 is made of an elastomeric or flexible material, such as rubber or polytetrafluoroethylene (PTFE) or thermoplastic elastomers, among other suitable materials. The annular gasket 364 defines an outer diameter that is equal to a dimension of the mounting hole 260, such as the second diameter D2. In this way, the annular gasket 364 is configured to engage with the engagement wall 264 of the track 356 when positioned in the mounting hole 260 at the second end 236 of the track 356, thereby acting as a locking feature of the knob 354 to resist dislocation or translation within the track 356. Further, the annular gasket 364 can be rotated within the mounting hole 260 sufficiently to allow portions of the cord 220 to become wrapped around the spool 304, as desired by a user for finer adjustment of footwear 200 tightening forces. At the same time, due to the elastomeric properties, the frictional resistance between the annular gasket 364 and the engagement wall 264 of the track 356 is tuned to be sufficient to hold or secure the knob 354 against rotation when released by a user. In addition, because of the elastomeric properties of the annular gasket 364, the axle 360 can be pushed or translated through the throat 276 of the track 356, compressing the annular gasket 364, until the axle 360 is positioned in the slot 256 where the annular gasket 364 can then return to its original shape, i.e., decompress. In this way, the knob 354 provides the same functionality as the knob 284 of FIG. 8 but with a shorter height, i.e., a distance from the head 288 to the base 336.

Figure 12:
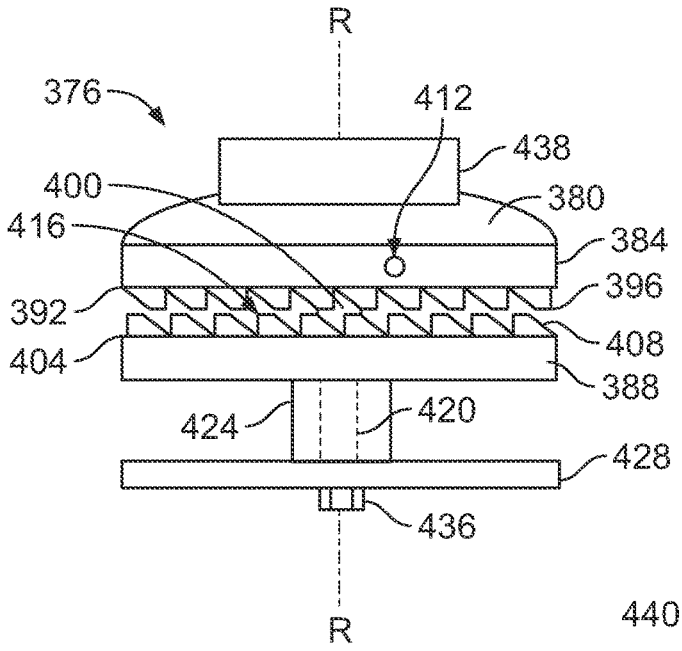
FIG. 12 is a schematic representation of a side elevational view of yet another embodiment of a knob for a closure system for an article of footwear.

FIG. 12 depicts another embodiment of a knob 376 that includes a locking feature in the form of a modified head 380 having an upper disc 384 and a lower disc 388. The upper disc 384 of the head 380 includes a bottom surface 392 from which a plurality of angled teeth 396 extend radially symmetrically. A shaft 400 is connected to the bottom surface 392 of the upper disc 384 and the rotation axis R passes therethrough. Further, the lower disc 388 of the head 380 includes an upper surface 404 from which a plurality of counter-angled teeth 408 extend radially symmetrically. The angled teeth 396 are configured to engage, e.g., interlock, with the counter-angled teeth 408 to secure the upper disc 384 to the lower disc 388, such that rotation of the upper disc 384 and/or the lower disc 388 relative to one another is prevented when secured together. In addition, a passage 412 is positioned within the upper disc 384 such that rotation thereof causes more or less of the cord 220 to become wrapped around the upper disc 384. It is contemplated that portions of the cord 220 can be wound around the shaft 400 between the upper disc 384 and the lower disc 388 within an annular space 416 that surrounds the shaft 400, which is further enabled by a resilient, flexible material of the cord 220 to allow for compression between and/or among the angled teeth 396 and counter-angled teeth 408.

Further, similar to the knob 354 of FIG. 10, the knob 376 has an axle 420 with an annular gasket 424 disposed around and coupled to the axle 420 between a base 428 and the lower disc 388. In some embodiments, the upper disc 384 includes an elongated fin 438 for improving a user's grip thereof. In some embodiments, the upper disc 384 is configured to be rotatably mounted on the shaft 400 while the lower disc 388 is configured to be fixedly mounted on the shaft 400. For example, the shaft 400 may be threaded into the bottom surface 392 of the upper disc 384 so that partially unthreading the upper disc 384 from shaft 400 moves the upper disc 384 away from the lower disc 388, bringing the angled teeth 396 and the counter-angled teeth 408 out of engagement. In some embodiments, the upper disc 384 is configured to be fixedly mounted to the shaft 400 and both the upper disc 384 and the shaft 400 are configured to be rotated relative to the lower disc 388. For example, the shaft 400 is concentrically disposed within the axle 420 and secured to the base 428 by a nut 436, such that the shaft 400 can be rotated relative to the axle 420 and the base 428. Further, the shaft 400 has a dimension, e.g., a height, allowing for vertical movement relative to the base 428 and the axle 420, such that when the upper disc 384 is lifted away from the lower disc 388 the nut 436 is brought into contact with the base 428; then, when the upper disc 384 is lowered toward the lower disc 388, the nut 436 will be spaced apart from the base 428. The knob 376 may be used with the engagement wall 264 of the tracks 344, 356 of FIGS. 9 and 11, respectively, to comprise another embodiment of a closure system for the footwear 200.

Figure 13:
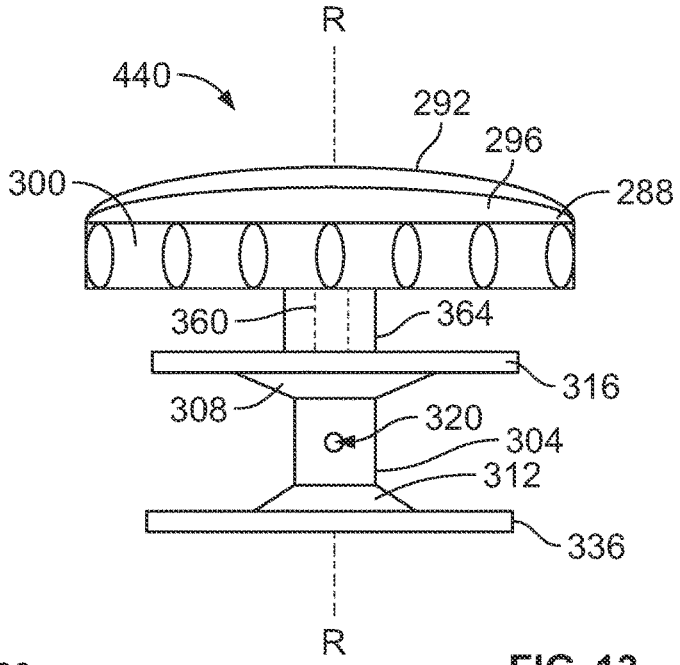
FIG. 13 is a schematic representation of a side elevational view of another embodiment of a knob for a closure system for an article of footwear.

FIG. 13 depicts yet another embodiment of a knob 440, most similar to the knob 354 of FIG. 10, but where the spool 304 and the axle 360 are rearranged relative to the head 288. As illustrated in FIG. 13, the axle 360 with the annular gasket 364 disposed thereon extends between the flange 316 and the head 288, and the spool 304 extends between the flange 316 and the base 336, below the axle 360. In this way, the knob 440 of FIG. 13 is configured to guide the cord 220, when passed through the passage 320, around the spool 304 and below the flange 316 and the axle 360. The knob 354 may be used with the engagement wall 264 of the tracks 344, 354 of FIGS. 9 and 11, respectively, to comprise still another embodiment of a closure system for the footwear 200.

Figure 14:
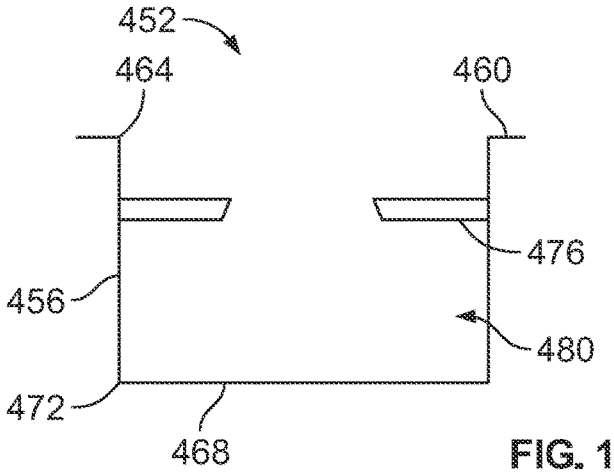
FIG. 14 is a schematic representation of a cross-sectional view of a track for a closure system for an article of footwear.

Referring to FIG. 14, a schematic representation of a cross-sectional view of an embodiment of a track 452 illustrates a sidewall 456 that includes a lip 460 extending outwardly at a top end 464. The sidewall 456 extends from the top end 464 down to a bottom wall 468 at a bottom end 472. Further, an engagement wall 476 extends inwardly from the sidewall 456 at a distance from the bottom wall 468, being closer to the top end 464 than to the bottom end 472. As a result, the engagement wall 476 forms a chamber 480 within the track 452 and between the bottom wall 468 and the engagement wall 476. It will be appreciated that the engagement wall 476 forms the slot 256, mounting hole 260, and throat 276 of the track 344. It is contemplated that the spool 304 of the knob 440 may be positioned within the chamber 480 when the knob 440 is used with the track 452. Accordingly, the cord 220 can be wound around the spool 304 within the chamber 480, being concealed by the engagement wall 476 and, thus, hidden from view and protected from an environment surrounding the footwear 200.

Figures 15, 16, 17:
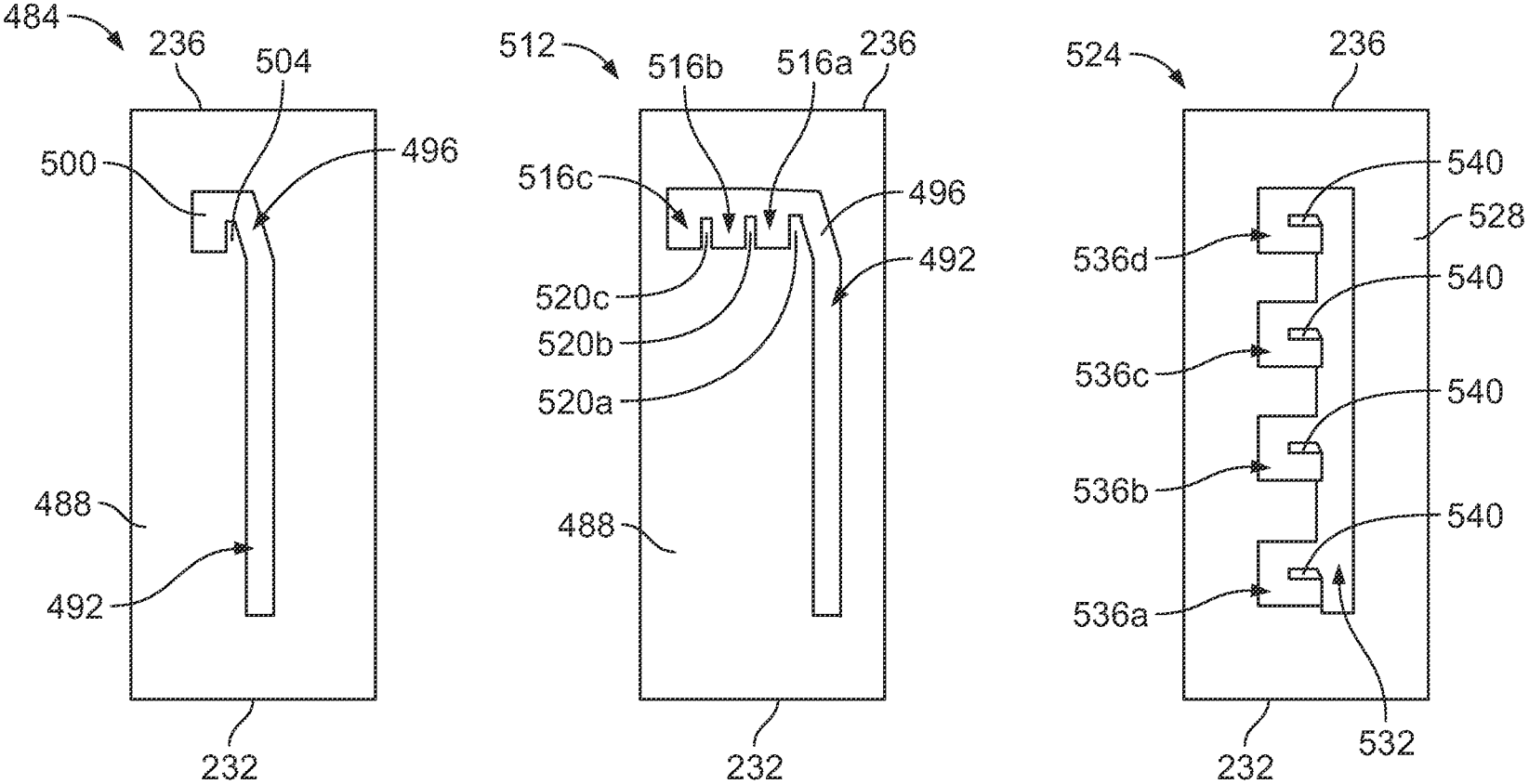
FIG. 15 is a schematic representation of a top plan view of yet another embodiment of a track for a closure system for an article of footwear.
FIG. 16 is a schematic representation of a top plan view of yet another embodiment of a track for a closure system for an article of footwear.
FIG. 17 is a schematic representation of a top plan view of yet another embodiment of a track for a closure system for an article of footwear.

In FIG. 15, another embodiment of a track 484 includes an engagement wall 488 that defines a linear slot 492 having a slanted section 496 extending at an angle toward a pit 500. The slot 492 extends from the first end 232 of the track 484 toward the second end 236, and the slanted section 496 and pit 500 are located at or adjacent the second end 236 of the track 484, i.e., away from the winding region 216 when installed on the footwear 200. It will be appreciated that any of the knobs 212, 284, 354, 376, 440 described above can be translated within the slot 492 and through the slanted section 496 to become mounted within the pit 500. Because the pit 500 is located at the second end 236 of the track 484, being offset from the slot 492 and separated from the slot 492 by a bumper 504, any of the knobs 212, 284, 354, 376, 440 remain held in place in the pit 500 with assistance from the tensioning or tightening force applied to the knobs 212, 284, 354, 376, 440 by the cord 220. The track 484 can be used with any of the knobs 212, 284, 354, 376, 440 to comprise a closure system for the footwear 200.

FIG. 16 depicts another embodiment of a track 512, similar to the track of FIG. 14, except with multiple pits 516*a*, 516*b*, 516*c* arranged consecutively in a row. In the illustrated embodiment, the slanted section 496 is adjacent an innermost or first pit 516*a* that is partially defined by a first bumper 520*a*. A center or second pit 516*b* is separated from the innermost pit 516*a* by a second bumper 520*b* so as to be adjacent the innermost pit 516*a* and opposite the first bumper 520*a*. An outermost or third pit 516*c* is separated from the center pit 516*b* by a third bumper 520*c* so as to be adjacent the center pit 516*b* and opposite the second bumper 520*b*. In this way, a user can move any of the knobs 212, 284, 354, 376, 440 into and out of secure engagement within any of the pits 516*a*, 516*b*, 516*c*, while held in place by assistance from the tensioning or tightening force applied to the knobs 212, 284, 354, 376, 440 by the cord 220. Further, because the center pit 516*b* is positioned an incrementally greater distance from the winding region 216 than the innermost pit 516*a*, and the outermost pit 516*c* is positioned an incrementally greater distance from the winding region 216 than the center pit 516*b* and the innermost pit 516*a*, a user can selectively adjust the tensioning or tightening force applied to the footwear 200 by the cord 220 through location of the knobs 212, 284, 354, 376, 440 within any of the pits 516*a*, 516*b*, 516*c*. The track 512 can be used with any of the knobs 212, 284, 354, 376, 440 to comprise a closure system for the footwear 200.

FIG. 17 depicts still another embodiment of a track 524 having an engagement wall 528 that defines a linear raceway 532 extending from the first end 232 to the second end 236 and including a plurality of corrals 536*a*, 536*b*, 536*c*, 536*d* spaced apart therealong. Each of the corrals 536*a*, 536*b*, 536*c*, 536*d* is at least partially defined by a thin bar 540 in the form of an L-shaped member that is rotated 180 degrees, although other configurations are possible. Each bar 540 extends from the engagement wall 528 and partially separates the respective corral 536*a*, 536*b*, 536*c*, 536*d* from the raceway 532. The first corral 536*a* is located closer to the first end 232 and the fourth corral 536*d* is located closer to the second end 236, while second and third corrals 536*b*, 536*c* are spaced sequentially therebetween, as illustrated in FIG. 17. It will be appreciated that any of the knobs 212, 284, 354, 376, 440 can be moved along the raceway 532 and into any of the corrals 536*a*, 536*b*, 536*c*, 536*d* to adjust the amount of tensioning or tightening force on the footwear 200. Because the corrals 536*a*, 536*b*, 536*c*, 536*d* are located along the raceway 532 spaced apart between the first end 232 and the second end 236, the track 524 provides a wide range of adjustment of the tensioning force on the footwear 200. The track 524 can be used with any of the knobs 212, 284, 354, 376, 440 to comprise a closure system for the footwear 200.

It is also contemplated that any of the knobs 212, 284, 354, 376, 440 may be provided with or modified to include a closure mechanism similar to those disclosed and described in U.S. Pat. Nos. 5,325,613; 5,600,875; 5,606,778; 5,638,588; 5,651,198; and 5,669,116, which are all commonly assigned to Puma SE and incorporated by reference in their entirety herein. It is contemplated that the knobs 212, 284, 354, 376, 440 may be modified to include the closure mechanisms in place of or in addition to a head to provide further tightening functionality when used with the cord 220 and mounted on the footwear 200 of the present disclosure.

It will be appreciated that the knobs 212, 284, 354, 376, 440 and the tracks 208, 344, 356, 452, 484, 512, 524 may be made of a thermoplastic material, e.g., thermoplastic polyurethane (TPU), although other suitable materials may be used. In some embodiments, the tracks 208, 344, 356, 452, 484, 512, 524 are each manufactured as single, unitary components, or, alternatively, as discrete components welded, fused, adhered, or fastened together. In some embodiments, any of the tracks 208, 344, 356, 452, 484, 512, 524 may be coupled to the footwear 200 by adhesives, fasteners, e.g., stitching or rivets, welding, fusing, or otherwise suitably attaching to one or both of the upper 102 and the sole 104.

In other embodiments, other configurations are possible. For example, certain features and combinations of features that are presented with respect to particular embodiments in the discussion above can be utilized in other embodiments and in other combinations, as appropriate. Further, any of the embodiments described herein may be modified to include any of the structures or methodologies disclosed in connection with other embodiments. Additionally, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

INDUSTRIAL APPLICABILITY

Numerous modifications to the present invention will be apparent to those skilled in the art in view of the foregoing description. Accordingly, this description is to be construed as illustrative only and is presented for the purpose of enabling those skilled in the art to make and use the invention. The exclusive rights to all modifications which come within the scope of the appended claims are reserved.

We claim:

1. An article of footwear having an upper, a sole, and a closure system, the closure system comprising:
   - a track;
   - a knob; and
   - a cord that is configured to be operably engaged with an upper of the footwear, wherein the cord is attached to the knob, wherein the knob is configured to be moved by translation and rotation within the track to tighten and loosen the footwear, the knob being translatable along a linear axis X and rotatable about a rotation axis R that intersects the linear axis X, and wherein the track extends across the upper and the sole of the footwear.

2. The article of footwear of claim 1, wherein the cord is operably engaged with a plurality of guides defining a winding region of the footwear.

3. The article of footwear of claim 2, wherein the track has a first end that is located closer to the winding region than a second end.

4. The article of footwear of claim 3, wherein the footwear is tightened when the knob is positioned at the second end of the track.

5. The article of footwear of claim 2, wherein the knob is configured to be translated and rotated within a channel defined by the track.

6. The article of footwear of claim 1, wherein the track extends along the upper within a heel region.

7. An article of footwear having an upper, a sole, and a closure system, the closure system comprising:
   - a track having a first end and a second end, wherein the track extends across the upper and the sole of the footwear, wherein an engagement wall extends from the first end to the second end, and wherein the track has projections that narrow the track at one end;
   - a knob that is configured to be received within the track when assembled, wherein the knob engages with the projections; and
   - a cord that is configured to be operably received by the knob, the cord being inserted through openings formed in the track, and wherein the knob is configured to be rotated and translated within the track to tighten the footwear.

8. The article of footwear of claim 7, wherein the knob includes a head and an axle.

9. The article of footwear of claim 8, wherein the axle of the knob includes an annular gasket disposed thereon.

10. An article of footwear having an upper, a sole, and a closure system, the closure system comprising:
   - a track having a first end and a second end, wherein the track extends across the upper and the sole of the footwear, wherein an engagement wall extends from the first end to the second end;

a knob that is configured to be received within the track; and a cord that is configured to be operably received by the knob, the cord being inserted through openings formed in the track, and wherein the knob is configured to be rotated and translated within the track to tighten the footwear.

* * * * *